United States Patent [19]

Chapin

[11] 4,232,468

[45] Nov. 11, 1980

[54] COMBINATION BREECH-LOADING TO MUZZLE-LOADING FIREARM CONVERTING DEVICE AND PROJECTILE CASING

[76] Inventor: Paul D. Chapin, 1936 Fifth St., Ceres, Calif. 95307

[21] Appl. No.: 29,184

[22] Filed: Apr. 12, 1979

[51] Int. Cl.[3] ..... F41C 21/10

[52] U.S. Cl. ..... 42/77; 42/51

[58] Field of Search ..... 42/77, 51

[56] References Cited

U.S. PATENT DOCUMENTS

| | | | |
|---|---|---|---|
| 158,221 | 12/1874 | Smith | 42/51 |
| 173,476 | 2/1876 | Ladd | 42/77 |
| 3,196,569 | 7/1965 | Thomason | 42/77 |
| 3,780,464 | 12/1973 | Anderson | 42/51 |

*Primary Examiner*—Charles T. Jordan

*Attorney, Agent, or Firm*—Townsend and Townsend

[57] ABSTRACT

A cylindrical plug that is configured to be removably inserted into the breech of a breech-loading firearm, converts the firearm to one of a muzzle-loading type. The plug is provided with a primer-receiving chamber at one end, a powder charge chamber at the other end, and a passage that establishes communication between the two chambers. The primer-receiving chamber is adapted to receive a percussion-type primer, detonation of which generates ignition products which are communicated via the flash to a main powder charge situated in the charger chamber of the plug to cause combustion of said charge and propel a projectile or projectiles from the firearm. Alternatively, the plug is structured so that it can function as a reusable casing for holding a powder charge and a projectile or projectiles to function, for example, as a shotgun shell.

6 Claims, 4 Drawing Figures

COMBINATION BREECH-LOADING TO MUZZLE-LOADING FIREARM CONVERTING DEVICE AND PROJECTILE CASING

This invention relates to firearms and more particularly to a device that alternately functions to convert a breech-loading firearm to a muzzle-loading firearm.

DESCRIPTION OF THE PRIOR ART

The evolution of firearms, resulting in the metallic cartridge-receiving, breech-loading arms used today, has seen many stages of development. One such development stage saw large use of the percussion lock, muzzle-loading firearm which, for the most part, was fired by communicating a first combustion via a small passage in the breech of the gun to the main propellant charge. Typically, this type of firearm was provided with a small channel, commonly called the touch-hole, to establish communication between the exterior of the breech of the firearm barrel and the firing chamber. A fulminate was placed at the exterior orifice of the channel and, when the trigger was pulled, a hammer or other type plunger was driven down on the fulminate, which exploded, sending its flame to the main charge.

Sometime between 1814 and 1820, the percussion cap was invented. A small quantity of fulminate was contained in a tiny copper shell covered by a tinfoil disc and sealed with a drop of shellac. The cap was placed on a nipple that formed the external orifice of the channel that led directly to the charge. When the hammer struck the cap a flame spurted down the channel and fired the gun instantly. There was no flash at the breech, no delay in firing, no loss of compression, and complete protection from dampness. The percussion-cap firearm was not superceded until the brass cartridge containing its exploder inside appeared in the middle of the 19th Century shortly before the American Civil War.

Although the brass cartridge firearm now dominates the weapons scene, percussion lock firearms are still in use and there has been of late a resurgence in such front or muzzle-loading guns. In fact, the past few years have seen the sale of such arms and supplies become a million-dollar business, with such large firearm firms as Lyman, Thompson/Center and Colt now entering the field.

The gun fancier who becomes interested in muzzle-loading firearms for recreation can purchase, recondition, maintain and perhaps restore an authentic old (muzzle-loading) firearm. Alternately, he may purchase one of the many domestic or foreign-made replicas of percussion lock, muzzle-loading firearms presently supplying today's demand. He may also satisfy his interest by purchasing and assembling one of the many muzzle-loader kits available on the market today. However, any one of these alternatives presents a somewhat expensive venture into the muzzle-loading field.

Alternately, of course, the gun fancier who desires to enter the muzzle-loading firearm sport, yet wishes to keep a hand in brass cartridge breech-loading firearms, must undergo the expensive of purchasing and/or owning two firearms.

Several manufacturers today are selling muzzle-loading firearms which are adaptations and conversions of the breech-loading firearms that they typically produce. However, these adaptations typically involve threading the barrel breech (the chamber area) to accept a short removable breech plug fitting with a percussion nipple that is screwed centrally into its rear face. Such adaptations of breech-loading firearms can no longer be used as a breech loader. Thus, the user again purchases this type of firearm for muzzle-loading use only and must purchase a breech-loading firearm if he wishes to own and/or use both types of firearms. One example of this latter type of firearm conversion may be found in U.S. Pat. No. 3,780,464.

SUMMARY OF THE INVENTION

The present invention obviates the above-identified problems by providing a conversion plug that is easily and removably inserted into the breech of a breech-loading firearm to convert the firearm to one of the muzzle-loading variety. The invention is inexpensive to fabricate, simple to use, highly effective in converting a breech-loading firearm to a muzzle-loading type, and requires no modifications to the firearm. Thus, the firearm can serve as a muzzle-loading or breech-loading device. As will be seen, the invention is structured so that it is capable of alternately functioning as a reusable shell casing.

The invention generally includes a conversion plug that is configured to be removably inserted into the breech of a breech-loading firearm. One end of the plug (the breech end) is provided with a primer chamber that is adapted to receive a percussion-type primer. The opposing end of the plug is provided with a powder chamber for receiving the main powder charge. A flash passage interconnects the two chambers so that the ignition products generated by detonation of the primer (as by being struck by the firing pin by the firearm) are communicated from the primer chamber to the powder chamber.

In the preferred embodiment, the primer chamber, flash passage and powder chamber are formed coaxial with each other and the conversion plug, forming an opening that runs from one end of the plug to the other. The primer chamber is dimensioned to removably receive a battery-cup type primer. The powder chamber is dimensioned to receive and contain a powder charge, wadding and projectile so that the invention can alternately function as a reusable projectile casing when not in use as a conversion device. The flash passage communicating the primer and powder chambers to one another is dimensioned to allow communication of ignition products produced by detonation of the primer from the primer to the powder charge, yet minimize "back flash" from combustion of the main powder charge.

A number of advantges are achieved by the present invention over any similar apparatus presently available. The principal advantage is the fact that conversion of the firearm from a breech-loader to a muzzle-loader requires no structural modification of the firearm itself. Accordingly, the firearm can readily be adapted for use as a breech-loading device when desired by merely removing the conversion plug from the breech.

A further advantage of the present invention resides in the fact that it contains no moving parts. Repeated use of the plug will naturally cause the accumulation of gun powder combustion by-products on the interior surfaces of the plug. The surfaces may easily be cleaned because they are readily accessible. Such would not be the case if moving parts were needed, which parts usually are held captured in interior chambers.

An additional advantage is achieved by the particular structure of the invention which allows its use as a projectile casing, with the firearm being used as a normal breech-loading device.

These and other advantages, as well as a fuller understanding of the nature of the invention, will readily be obtained with reference to the ensuing detailed description, preferably taken in conjunction with the accompanying drawings.

DETAILED DESCRIPTION OF THE DRAWINGS

Figure 1:
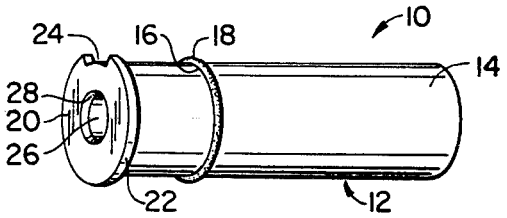
FIG. 1 is a perspective view illustrating the present invention.
Figure 2:
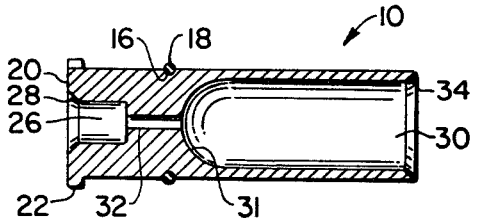
FIG. 2 is a side sectional view of the invention shown in FIG. 1.

Referring now to the drawings, the conversion plug of the invention, generally designated by the reference numeral 10, is illustrated in the form of an elongate cylindrical body 12 having a relatively smooth outer surface 14 that is configured to conformably mate with an interior surface of a breech of a breech-loading firearm. The outer surface 14 has formed therein a circumferentially oriented groove 16 that removably holds an annular seal 18. A first end 20 is provided with a surrounding, radially extending flange 22 which, in turn, has formed therein a notch 24.

Formed in the first end 20 is an opening or primer chamber 26 having a generally beveled orifice 28. The other end of the body 12 is provided with a cylindrically shaped powder chamber 30 which extends longitudinally into the body 12 to terminate short of the primer chamber 26 in a smooth, hemispherically shaped interior end 31. The exterior end of the powder chamber is provided with an outward opening bevel 34. A flash passage 32 provides fluid communication between the primer chamber 26 and the powder chamber 30.

The body 12 is generally configured to be slidably but snugly inserted into the breech or firing chamber of a breech-loading firearm. The outer diameter of body 12 is dependent upon the inner diameter of the breech or firing chamber of the particular firearm in which the plug is to be used. However, the diameter should be sufficient to allow the plug to be easily inserted into the breech of the firearm, yet fit therein relatively snugly. The length of the body 12 of the plug is determined by the depth of the particular breech in which the invention will be used.

The annular seal ring 18 acts to protect the interior surface of the breech of the firearm in which the plug 10 will be inserted. Additionally, the seal ring aids in effecting a seal between the body 12 of the plug and the interior surfaces of the breech. Presently, the seal ring 18 is fabricated from an elastomeric material.

The plug 10 itself is preferably fabricated from a material having high heat conductivity such as, for example, aluminum. This allows the plug to communicate any heat generated therein by combustion of the main charge quickly to the chamber and barrel of the firearm and thereby be dissipated.

The primer chamber dimensions are dependent upon the particular type of primer selected. Preferably, the primer chamber 26 is dimensioned to removably receive a battery-cup type primer such as, for example, the Model 209 type primer commercially available from Remington Arms Company, Inc., Bridgeport, Conn. and sold under the "Klean Bore" trademark. Such primers are preferred for the reason that they tend to retain their shape and will not appreciably expand when detonated. Accordingly, such battery-cup primers can be easily inserted in the primer chamber 26, detonated, and easily removed. Other primer types, although capable of functioning as a detonating primer, tend to swell upon detonation and may require some effort to remove when spent (ignited).

Figure 3:
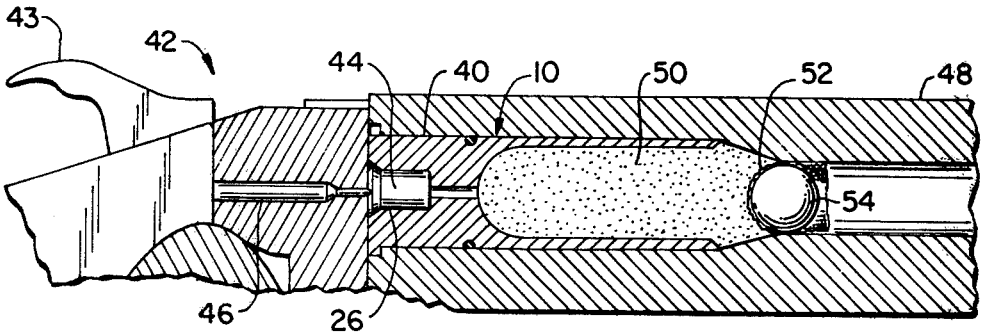
FIG. 3 is a partial cross-sectional view of a firearm of the conversion plug of the present invention inserted in the breech of the firearm, illustrating use of the invention in converting the firearm to one of a muzzle-loading variety.

In operation, the conversion plug 10 is inserted into the breech 40 of the breech-loading firearm 42, illustrated in FIG. 3. Many breech-loading firearms are provided with an ejection mechanism which acts to eject the (spent) shell from the firearm's breech. Typically, such ejection mechanisms include a push-rod which lies parallel to the barrel of the firearm and extends out and rearward from the breech when opened. The push-rod engages the flange of the shell to eject it from the breech. When the firearm is converted to a muzzle-loading type by the present invention, such ejection is unwanted. Accordingly, the notch 24 is formed in the flange 22 of the conversion plug 10 to avoid the ejection action of any such push-rod (or similar apparatus). Thus, when the conversion plug 10 is placed in the breech 40 of the firearm 42, the notch 24 should be appropriately aligned to avoid any ejection mechanism of the firearm.

With the plug so inserted in the breech 40 of the firearm 42, the firearm is now converted to one of a muzzle-loading variety. To complete preparation for firing the firearm 42, one merely need point the barrel 48 of the firearm generally vertically upwards and introduce into the barrel 48 the main powder charge 50 followed by a wet or greased paper or cloth wadding 52 and the ball or projectile 54. Typically, the ball 54 is wrapped in the paper or cloth wadding 52 and tamped by a ramrod (not shown) or the like to place the ball 54 snugly proximate the main powder charge 50.

Having loaded the firearm wiht the main powder charge 50, and the wadding/ball combination 52 and 54, it is preferable at this point, rather than prior to loading the main powder charge, that a primer 44 (preferably a battery-cup primer, as explained), be inserted in the primer chamber 26 of the conversion plug 10. There are two reasons for this caveat. First, for safety's sake, the primer 44 should be the last step in readying the firearm for firing to avoid possible detonation of the primer while the firearm 42 is being loaded.

A further caveat is in order at this point. As most of those skilled in this art are probably aware, no muzzle-loading firearm, be it rifle, pistol or shotgun, can be safely fired with any form of modern smokeless powder. Therefore, again for safety's sake, any firearm or shotgun powder from a cartridge should never be used in any muzzle-loading type firearm. Even if made of modern steel and very strong, muzzle-loading firearms are normally not designed to handle the pressure curve of smokeless powder.

On the other hand, if the firearm 42 is of good condition, it will easily handle a double load of black powder or replacement for black powder such as the substance referred to as "the replica black powder" sold under the "Pyrodex" trademark by Pyrodex Corporation. In frontier days, double charges were used whenever the shooter needed more power or range. So, generally speaking, one cannot get into too much trouble with black powder or its appropriate equivalent. However, it can get the gun in trouble if fouling is not kept down, as black powder and the water and greases normally used make quite a mess.

With the primer 44 situated in primer chamber 26, the breech 40 is snapped shut to position the primer generally axial of the firing pin 46 of the firearm 42. It should be noted that the primer chamber 26 is appropriately located, relative to the firing pin 46, so that when the breech 40 of the firearm 42 is closed and readied for firing, the firing pin 46 is situated generally coaxial and proximate the primer 44.

So loaded, the firearm 42 is fired when the hammer 43 is caused to strike the firing pin 46 to cause impact detonation of the primer 44. Such detonation generates ignition of whatever charge is utilized by the primer 44 (usually a fulminate) to generate an ignition product in the form of hot gases which expand and are communicated to the main powder charge 50 via the flash passage 32. The main charge 50 is thereby ignited and the resultant expanding gases of the combustion propel the ball 54 out of the barrel 48 of the firearm 42 and on to its destination.

These same expanding gases created by combustion of the main powder charge 50 conceivably have a "flashback" path via the flash passage 32. However, it has been found that by limiting the effective cross-sectional area of the flash passage 32 to the equivalent of a circle having a diameter in the range of 0.061–0.080 inches, any flashback produced by combustion of the main powder charge 50 is negligible. If the effective cross-sectional area of the flash passage 32 is less than a circular area having a diameter less than 0.061 inches, misfire problems are encountered; communication of the ignition products from the detonated primer 44 to the main powder charge is substantially restricted. A flash passage having an effective cross-sectional area of a circle with a diameter greater than 0.080 inches fails to provide sufficient restriction and flashback may become appreciable. It has been found that a 0.070 inch diameter provides a flash passage that substantially restricts flashback, yet minimizes misfires by providing good fluid communication to the main powder charge 50 for the ignition products of the primer 44.

The above discussion, of course, has pointed out the use of the conversion plug 10 to convert a breech-loading firearm, such as the firearm 42 depicted in part in FIG. 3, to one of a muzzle-loading variety. However, when the firearm is to be used in its breech-loading capacity, the conversion plug 10 of the present invention can also function as a shell casing containing previously prepared loads of powder charge and projectile or projectiles, as the case may be. For example, with reference to FIG. 4 there is illustrated the conversion plug 10 in its alternate use.

Figure 4:
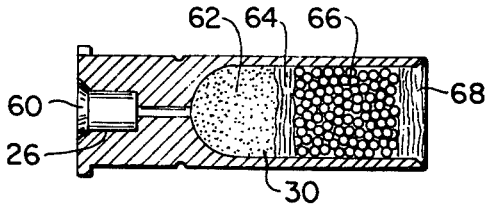
FIG. 4 is a side cross-sectional view of the invention shown in FIG. 1 functioning as a loaded shell casing with a primer cap inserted in the primer chamber and a powder charge, wadding and projectile shot loaded in the powder chamber.

The conversion plug 10 of FIG. 4 is prepared sometime prior to expected use. First, the powder chamber 30 of the conversion plug 10 is loaded with a powder load 62. On top of the powder load 62 is inserted (in powder chamber 30) a first cardboard or paper wad 64. The powder load 62 and wad 64 are then compressed as desired. The projectile load, in this case a plurality of shot 66, each having a generally spherical shape, is placed in the powder chamber 30 on top of the wadding 64 and a second wadding 68 used to seal the chamber 30. Left to be installed is the battery cup primer 60. This step can wait, however, until the prepared plug 10 of FIG. 4 is to be put into use.

So prepared, the conversion plug 10 of FIG. 4 can then be loaded into a breech-loading firearm. At this point, care should be taken to avoid aligning the gap 24 with any ejection mechanism the firearm may have. For, unlike the use described above (use that converts the firearm to a muzzle-loader) once the loaded plug is fired, it is desired to be ejected so that another loaded plug (or shell) can be used. The battery-cup primer 60 is then inserted, the breech snapped shut and the loaded plug fired. It can then be removed or ejected and, at a later time, again prepared for reuse. Note that a user could carry a number of such prepared conversion plugs and use them as needed.

While the above provides a full and complete disclosure of the preferred embodiments of the invention, various modifications, alternate constructions and equivalents may be employed without departing from the true spirit and scope of the invention. Therefore, the above description and illustrations should not be construed as limiting the scope of the invention which is defined by the appended claims.

What is claimed is:

1. A device for removable insertion into a breech of a standard, unmodified, breech-loading firearm, the device being alternately usable as a preloaded, projectile-containing casing or for converting said firearm to one of a muzzle-loading variety, the device comprising:

a cylindrically shaped body member having opposed ends and an outer surface configured for mating engagement with the interior of the breech of said firearm, the body member being formed with a primer-receiving chamber at one of said opposed ends and a powder charge chamber at the opposite end, said primer-receiving and powder charge chambers being interconnected by a fluid communicating passage having an effective section generally equal to the area of a circle having a diameter in the range of 0.061 inches–0.080 inches.

2. The device of claim 1, wherein said firearm includes an ejection mechanism operable to eject projectile casings having a radially extending flange positioned in surrounding relation to one end of said casing, the device including a radially extending flange partially and circumferentially surrounding said one of said opposed ends and adjacent thereto, said flange terminating in a pair of spaced, generally opposed ends that define an opening for avoiding said ejection mechanism.

3. The device of claim 1, wherein the primer-receiving and powder charge chambers are generally cylindrical and coaxial with one another and said body member.

4. The device of claim 3, wherein said communicating passage is coaxial with said body member.

5. The device of claim 1, wherein said body member has formed in the outer surface thereof a circumferentially oriented groove; and including an annular seal member situated in said groove.

6. The device of claim 1, wherein the effective section of said passage is generally equal to the area of a circle having a diameter of 0.070 inches.

* * * * *